US010228191B2

(12) United States Patent
Kux et al.

(10) Patent No.: US 10,228,191 B2
(45) Date of Patent: Mar. 12, 2019

(54) HIGH-PRESSURE PLATE HEAT EXCHANGER

(71) Applicant: Kelvion PHE GmbH, Sarstedt (DE)

(72) Inventors: Dirk Kux, Ratingen (DE); Markus Lentz, Grevenbroich (DE); Bernd Müller, Ratinger (DE); Gerd Abker, Marl (DE)

(73) Assignee: Kelvion PHE GmbH, Sarstedt (DE)

( * ) Notice: Subject to any disclaimer, the term of this patent is extended or adjusted under 35 U.S.C. 154(b) by 347 days.

(21) Appl. No.: 14/916,336

(22) PCT Filed: Sep. 10, 2014

(86) PCT No.: PCT/EP2014/069267

§ 371 (c)(1),
(2) Date: Mar. 3, 2016

(87) PCT Pub. No.: WO2015/036423

PCT Pub. Date: Mar. 19, 2015

(65) Prior Publication Data

US 2016/0223266 A1 Aug. 4, 2016

(30) Foreign Application Priority Data

Sep. 10, 2013 (EP) ..... 13183684

(51) Int. Cl.
*F28D 9/00* (2006.01)
*F28F 3/04* (2006.01)

(52) U.S. Cl.
CPC ..... *F28D 9/0006* (2013.01); *F28D 9/0037* (2013.01); *F28F 3/046* (2013.01); *F28F 2250/106* (2013.01)

(58) Field of Classification Search
CPC . F28D 9/0006; F28F 9/001; F28F 9/02; F28F 9/00075
See application file for complete search history.

(56) References Cited

U.S. PATENT DOCUMENTS 2,288,061 A * 6/1942 Arnold ..... F28D 9/0037 165/157
2,620,169 A 12/1952 Lawrence Gross William et al.
3,540,531 A * 11/1970 Becker ..... F25J 5/002 165/166
3,610,330 A 10/1971 Nasser
5,088,552 A * 2/1992 Raunio ..... F28D 9/00 165/165
5,755,280 A 5/1998 Da Costa et al.
(Continued)

FOREIGN PATENT DOCUMENTS

DE 2453961 A1 * 5/1976 ..... F28D 9/0006
DE 3618225 A1 12/1987
DE 3918189 A1 * 12/1990 ..... F28D 9/0006
(Continued)

*Primary Examiner* — Eric Ruppert
(74) *Attorney, Agent, or Firm* — Harness, Dickey & Pierce, P.L.C.

(57) ABSTRACT

The invention relates to a high-pressure plate heat exchanger having a polygonal plate packet that is arranged in a pressure chamber created by a housing, the housing having convexly curved flange covers. Said heat exchanger is characterized in that at least one of the flange covers has a polygonal opening for receiving the plate packet.

10 Claims, 6 Drawing Sheets

(56) References Cited

U.S. PATENT DOCUMENTS

| | | | | |
|---|---|---|---|---|
| 2012/0273173 | A1* | 11/2012 | Angermann | F28D 9/0037 165/134.1 |
| 2013/0277028 | A1* | 10/2013 | Heinio | F28F 3/046 165/166 |

FOREIGN PATENT DOCUMENTS

| | | | | |
|---|---|---|---|---|
| DE | 4343399 | A1 | 6/1995 | |
| DE | 19620543 | A1 * | 10/1997 | F28D 9/0037 |
| EP | 1085285 | A2 | 3/2001 | |
| GB | 2120768 | A | 12/1983 | |
| WO | WO-2010142306 | A1 | 12/2010 | |
| WO | WO-2010149858 | A1 | 12/2010 | |

* cited by examiner

4
M1
M2
21
21
k1
k2
19
19
IV
IV 16
17
k2
M2
20
19
20
15
21
20
14
18
16
k1
M1

16
14
20
20
15
19
14

HIGH-PRESSURE PLATE HEAT EXCHANGER

CROSS-REFERENCE TO RELATED APPLICATIONS

This application is a National Stage of International Application No. PCT/EP2014/069267 filed on Sep. 10, 2014 and claims priority to European Patent Application No. 13183684.3, filed on Sep. 10, 2013. The entire disclosures of the above applications are incorporated herein by reference.

BACKGROUND

This section provides background information related to the present disclosure which is not necessarily prior art.

Technical Field

The invention relates to a high-pressure plate heat exchanger having a plate packet which is of polygonal design and is arranged in a pressure chamber provided by a housing, wherein the housing has convexly curved flange covers.

Discussion

The high-pressure plate heat exchanger has a plate packet. The plate packet has, for example, first and second channels through which media can flow and which are arranged in cross flow or, in the event of multi-way capability, in cross counterflow. The first channel, which is provided for the first medium, is formed in a tubular manner between individual plates which are connected to one another to form a plate pair, and the second channel, which is provided for the second medium, is formed in a wavy manner between plate pairs which are connected to one another to form a plate stack.

A plate packet of the previously described type is known from DE 43 43 399 A1. A plate heat exchanger is disclosed here having channels through which the flow passes in cross flow and which, for the one medium, are formed in a wavy manner between individual plates which are in each case connected to form a plate pair and, for the other medium, are formed in a tubular manner between the plate pairs which are joined together to form a plate stack. In order to form the channels, the individual plates are equipped here with a plurality of parallel rows of cams or embossed supporting structures which are oriented in the flow direction of the one medium and are formed offset with respect to one another from row to row in the longitudinal direction. Furthermore, other embodiments of plate packets are also known.

The construction known from DE 43 43 399 A1 is not suitable for high-pressure applications, i.e. for media pressures of greater than 25 bar. This is not suitable in particular since said construction does not have sufficient mechanical stability for higher pressures and therefore may be deformed beyond the permissible extent at higher pressures.

In order to implement high-pressure use, plate heat exchangers in which a plate packet is arranged in a pressure chamber provided by a housing, which housing is closed on the end sides by convexly curved flange covers, are therefore known, for example from U.S. Pat. No. 5,755,280.

However, these plate heat exchangers are not suitable for all applications. The construction according to U.S. Pat. No. 5,755,280 thus has the requirement that the plate packets arranged closest to the flange covers have to be connected with the intermediate arrangement of an elongate connecting piece to a circular opening in the flange cover. This is required in order to be able to connect the plate packet of polygonal design in a fluid-tight manner to the connection, which is of circular design, in the opening of the flange cover.

It is disadvantageous in this connection that said connecting piece significantly extends the plate heat exchanger, and therefore the constructional shape of the plate heat exchanger cannot fall below a certain minimum size from the outset. In addition, the free corners of the rectangular plate packet are not suitable for high differential pressures.

Added to this is the fact that the connecting pieces have to be connected in a precisely fitting manner both to the plate packet and to the flange cover, which entails the risk of leakages or predetermined breaking points arising even during the assembly of the plate heat exchanger.

SUMMARY OF THE INVENTION

It is therefore an object of the invention to make a high-pressure plate heat exchanger more operationally reliable and more flexible in respect of the use possibilities.

In order to achieve this object, it is proposed by the invention that at least one of the flange covers has an opening of polygonal design for receiving the plate packet.

According to the invention, it is therefore provided that at least one of the flange covers has an opening of polygonal design for receiving the plate packet. Opening means an aperture, a recess and/or the like in the flange cover. The opening permits a fluidic connection between the interior of the housing and the environment. The opening is formed in a convexly curved region of the flange cover.

The opening is of polygonal design. This includes, for example, an opening of rectangular, in particular square, design. The polygonal shape of the opening relates to the clear dimensions of the opening, when viewing the opening frontally. The polygonal shape corresponds to the (imaginary) area of a segment cut out of the flange cover. However, polygonal within the context of the invention also includes a shape differing from a mathematically polygonal shape, i.e. a shape which, for example for manufacturing reasons, is rounded in the corner regions. It is crucial that the opening is not circular.

In accordance with the polygonal design of the opening, the edge of the opening, i.e. the edge forming the opening of the flange cover, does not lie in one plane, but rather has a three-dimensional profile. In the case of a square opening, the edge runs in a curved manner, for example starting from the corners of the square. The invention is also based, inter alia, on the finding that opening shapes other than circular openings can also be introduced into a convexly curved flange cover (see U.S. Pat. No. 5,755,280), i.e. in particular opening geometries in which the edge of the opening does not run in a single, common plane.

The opening in the flange cover is designed in accordance with the geometrical configuration of the plate packet. In the case of a plate packet of square design, the opening is, for example, likewise square. The opening is at least of such a size that the plate packet, in particular a connecting flange of the plate packet, can be accommodated therein.

The configuration according to the invention is associated with the advantage that the plate package can basically be fastened directly to the flange cover. The connecting pieces which are known from the prior art and have to be interconnected between the flange cover and the plate packet in such a manner that said parts are spaced apart from one another in the longitudinal direction of the heat exchanger or of the plate packet are omitted. With the configuration according to the invention, the end of a plate packet can be arranged directly in the region of a flange cover, and therefore the heat exchanger can be of significantly more compact design overall. This permits the installation of a high-pressure plate heat exchanger according to the invention even where the heat exchangers known from the prior art cannot be used because of the installation dimensions or constructional shape thereof. The high-pressure plate heat exchanger according to the invention can therefore be used more flexibly.

In addition, the configuration according to the invention has the advantage that the high-pressure plate heat exchanger is overall of more stable and operationally reliable design. The complicated calibration of the connecting pieces and the associated possibilities of error are overcome since, in the case of the invention, the plate packet can basically be simply inserted into the opening in the flange cover. The position of the plate packet is therefore fixedly predetermined by the opening itself, and therefore no calibration, adaptation work and/or the like are required.

Finally, the configuration according to the invention synergetically combines the advantages of plate heat exchangers in the high-pressure application, on the one hand, with the advantages of convexly curved flange covers in the high-pressure application, on the other hand, specifically without having to use error-prone connecting pieces which take up construction space.

According to an advantageous development of the invention, the plate packet is inserted into the opening with the intermediate arrangement of a frame. The frame can surround the plate packet, in particular on one side. The frame can be welded to the plate packet. The frame can serve to hold together the individual plates of the plate packet, in particular in a complementary manner. The frame permits an even simpler assembly of the high-pressure plate heat exchanger according to the invention. The plate packet is monolithically held together by the frame. Therefore, upon insertion into the opening of the flange cover, displacement or tilting of individual plates is prevented.

The frame is of polygonal design, specifically in particular in accordance with the opening in the flange cover, on the one hand, and the geometrical design of the plate packet, on the other hand. The external dimensions of the frame are selected in such a manner that said external dimensions substantially correspond to the internal dimensions of the opening in the flange cover. The frame, for its part, has an opening in which the plate packet can be at least partially accommodated. The internal dimensions of said opening substantially correspond to the external dimensions of the plate packet, in particular to a connecting contour of the plate packet.

According to an advantageous development of the invention, the depth of the frame is designed in such a manner that the frame is in contact with the flange cover over the entire edge of the opening. During correct use, the depth of the frame extends in the longitudinal direction of the housing or of the plate packet. As already described above, the edge of the opening does not lie in a plane, but rather has a three-dimensional profile. The depth of the frame is then selected in such a manner that those points of the edge of the opening which are furthest away from one another in the longitudinal direction are always in contact with the frame. As a result, the frame can be connected in a completely encircling manner to the flange cover, and therefore no leakage points whatsoever remain.

According to an advantageous development of the invention, at least one end of the plate packet opens directly into the opening of the flange cover. This means that the end of the plate packet extends in the longitudinal direction of the housing at least to an extent such that said end intersects an imaginary plane through the opening in the flange cover. As a result, the heat exchanger is constructed even more compactly.

The plate packet can basically have any structure. However, according to an advantageous development of the invention, the plate packet has first and second channels through which media can flow and which are arranged in cross flow and, for the first medium, are formed in a tubular manner between individual plates which are connected to one another to form a plate pair, and, for the second medium, are formed in a wavy manner between plate pairs which are connected to one another to form a plate stack, wherein the tubular channels are formed parallel to the longitudinal edges of the individual plates, and the individual plates are connected to one another along the longitudinal edges thereof to form plate pairs, and the plate pairs are connected to one another along the edges thereof, which run transversely with respect to the longitudinal edges of the individual plates, to form a plate stack, wherein the tubular side serves for the first medium and the wavy side serves as a pressure side for the second medium.

For reasons of optimized efficiency, that is to say an optimized transfer of heat, the pressurized second medium should be conducted on the wavy side of the plate packet. The tubular side of the plate packet conducts the first medium, which is under a lower pressure. In the case of the plate heat exchanger previously known from DE 43 43 399 A1, the tubular channels forming the tubular side extend transversely with respect to the longitudinal direction of the individual plates forming the plate packet. The transverse extent of an individual plate is limited here because of the production process by the width of the embossing tool, whereas a virtually endless extent, i.e. any selectable extent, is possible in the longitudinal direction.

It has been shown in practice that the tubular side of previously known plate heat exchangers has dimensions which are too short with regard to a desirable manner of heat transfer to be obtained in the case of high-pressure applications. It has therefore been proposed to connect a plurality of previously known plate heat exchangers one behind another on the tubular side in order thereby to be able to provide the required distance on the tubular side. Such a connection in terms of flow of individual plate heat exchangers requires the use of corresponding connections, connecting tubes, connecting hoses, deflections and/or the like, which may result in a disadvantageous manner in a partly considerable loss of pressure on the tubular side. In consequence, the efficiency of the heat exchanger drops in a disadvantageous manner, but this cannot be avoided in the case of previously known constructions.

The configuration according to the invention provides a remedy for this. In contrast to the previously known construction, a plate embossing which is rotated by 90 degrees is proposed, and therefore the tubular side, i.e. the tubes, run in the longitudinal direction of the plate. The channels which are formed for the first medium in a tubular manner between individual plates which are connected to one another to form a plate pair are thus formed parallel to the longitudinal edges of the individual plates. This leads as a result to it being possible to dispense with the connection one behind another in terms of flow of a plurality of plate heat exchangers since a configuration of the individual plates to the desired length can take place with the result of a dimensioning of the tubular flow channels in a manner adapted for the high-pressure application. The configuration according to the invention is therefore suitable in particular for high-pressure applications, specifically without the risk of power losses caused by a drop of pressure on the tubular side. In addition, the pressure-maintaining plates or the packet side walls can still be present since a configuration has to be undertaken only to the lower pressure of the tubular side.

Unlike, for example, tubular heat exchangers, plate heat exchangers are comparatively unstable to pressure. In particular if the individual plates are only connected at the edges, buckling of the individual plates and/or tearing of connecting points existing between the individual plates may occur under excessive pressurization. In order to avoid this, it is proposed with the configuration according to the invention to arrange the plate packet formed from individual plates within a pressure chamber which is provided by a housing. In the event of correct application, the plate packet is surrounded here by a supporting pressure which prevails in the pressure chamber and acts on the plate packet as a counterpressure. The construction according to the invention has proven advantageous in this regard insofar as pressure-maintaining plates or packet side walls have to be configured only with regard to the comparatively low pressure of the tubular side, i.e. of the first medium, which means that they can be used unchanged in the configuration thereof in comparison to the prior art, and while being simultaneously suitable for a high-pressure application within the meaning according to the invention. This advantageously leads to it being possible to use, even at comparatively high pressures of up to 100 bar and more, comparatively thin-walled individual plates which, for example, have a plate thickness of 1.2 mm to 2.0 mm, preferably of 1.3 mm to 1.8 mm, even more preferably of 1.5 mm.

In order to absorb the pressures prevailing in the event of operation, the housing providing the pressure chamber is preferably of spherical design, in a departure from the rectangular shape of the plate packet, and/or is of circular design with regard to at least one cross section. In order, firstly, to provide a housing which withstands the prevailing pressures during operation and which, secondly, permits the supply of medium to a plate packet of cuboidal design, it is furthermore provided structurally by the invention that the housing has adjoining flange covers on the tubular side of the plate packet, said flange covers being of at least partially spherical design. It is therefore ensured structurally that housing-side stress peaks are avoided in the transition region, that is to say the connecting region into the plate stack, and therefore comparatively high pressures can be absorbed with adequate safety tolerance, while simultaneously minimizing the required housing wall thicknesses and plate thicknesses. Accordingly, with the construction according to the invention, a housing is proposed which provides a pressure chamber and which outwardly separates the wavy side, i.e. with respect to the surrounding atmosphere, by a cylindrical casing and, with respect to the tubular side, by a spherical casing, and therefore, as a result, housing-side stress peaks in the transition region from the wavy side to the tubular side are avoided.

The configuration according to the invention makes it possible for the first time to use plate heat exchangers in the high-pressure range, specifically in the event of working pressures in respect of the second medium of over 50 bar, preferably of over 60 bar, even more preferably of over 100 bar to 120 bar. Previously known constructions do not permit such pressure applications. On the contrary, the working range of previously known constructions ends at a pressure of approx. 20 bar, optionally of approx. 30 bar. Pressures of over 30 bar, let alone 60 bar and more, are not possible with the previously known embodiments. The possible pressure range of over 120 bar with the configuration according to the invention, specifically without restriction by differential pressures, is surprising since the thickness of the exchanger plates used, on the one hand, and the housing wall thickness, on the other hand, turn out to be comparatively thin. In this respect, the wide pressure application range of the high-pressure plate heat exchanger according to the invention ensues as a synergistic effect from the previously explained individual features.

According to a further feature of the invention, connecting wedges are arranged in the corner regions of the plate stack between two adjacent plate pairs. Said connecting wedges are interconnected to the adjacent plate pairs, preferably in a form-fitting manner, by means of welding. The connecting wedges serve two purposes here. Firstly, stabilization of the entire plate packet construction is achieved. Secondly, the connecting wedges serve to separate wavy side and tubular side in terms of flow.

In order to form the individual flow channels, the individual plates provide embossed sections, as known per se from the prior art. In this case, the individual plates are provided with a plurality of parallel rows of embossed sections running in the longitudinal direction, and embossed sections of adjacent rows are oriented offset with respect to one another in the longitudinal direction. According to the invention, it is provided, in contrast to the prior art, to design a more narrowly pressed embossed image. Said embossed image which is narrower than in the prior art leads to improved support of the individual plates among one another and therefore to a reinforcement of the entire plate packet, which proves advantageous in particular in the event of a high-pressure application.

According to an advantageous development of the invention, the plate packet has empty points extending transversely with respect to the longitudinal direction of the plate packet, in particular of the individual plates. Empty point means that the plate packet or the individual plate is not provided with embossed sections and/or the like at this point. On the contrary, a region with a substantially flat extent throughout is involved. The empty point preferably extends over at least 80%, particularly preferably at least 90% of the width of the plate packet, in particular of an individual plate. The empty points serve to permit connection of individual plates of the plate packet to one another, specifically at a point away from the edges, which are spaced apart in the longitudinal direction of an individual plate. The empty points can extend, for example, centrally on an individual plate. The empty points therefore divide individual plates into subregions. If two individual plates with empty points are arranged one on the other, the two individual plates can be connected to one another, for example welded, in the region of the empty points. This configuration affords the advantage that, in comparison to a connection exclusively in the edge regions, the stability of the entire plate packet can be considerably improved. In addition, in certain embodiments of plate packet, the empty points can serve to form flow barriers. For example, a channel extending in a tubular manner through the plate packet can be interrupted by empty points. It is thus possible, for example, to achieve the effect that the flow can pass through one and the same continuous individual plate in an alternating manner, in particular in an alternating manner in cross flow, and consequently a multiple flow therethrough is achieved, which increases the efficiency of the plate heat exchanger.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention emerge from the description below with reference to the figures, in which.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
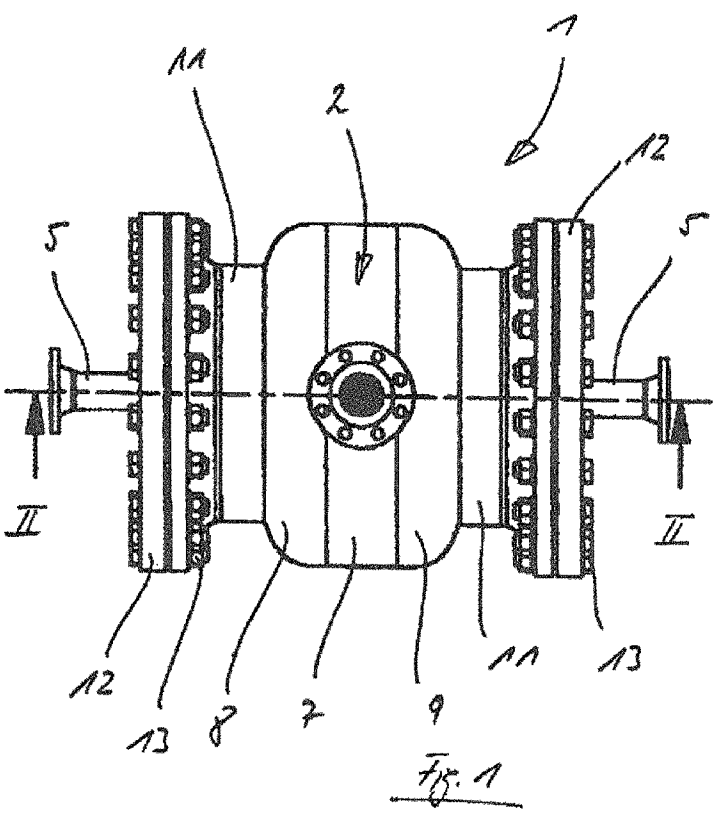
FIG. 1 shows, in a side view, a high-pressure plate heat exchanger according to the invention.

A high-pressure plate heat exchanger 1 according to the invention can be seen in a side view in FIG. 1. Said high-pressure plate heat exchanger has a housing 2 which, as the sectional illustration according to FIG. 2 reveals, provides a pressure chamber 3. A plate packet 4, which is only illustrated schematically in FIG. 2 for better clarity, is arranged within the pressure chamber 3.

FIGS. 3 to 6 reveal details of the plate packet 4. As emerges from said illustrations, the plate packet 4 is formed from individual plates 14. Two individual plates 14 together form a plate pair 15, and a plurality of plate pairs 15 coupled to one another constitute a plate stack 16.

Figures 3, 4, 5:
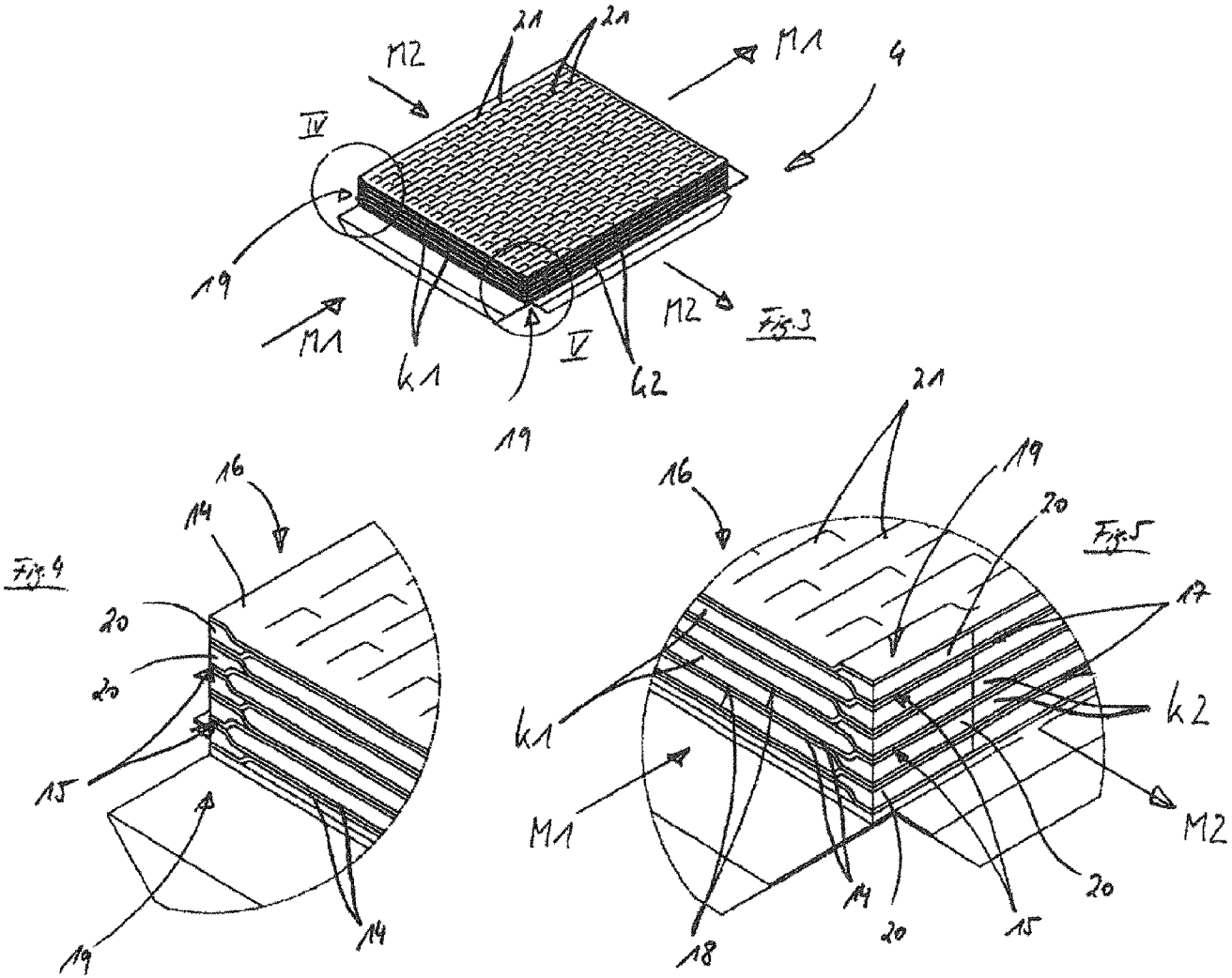
FIG. 3 shows a plate packet in a schematically perspective illustration.
FIG. 4 shows the detail IV according to FIG. 3 in a perspective illustration of the detail.
FIG. 5 shows the detail V according to FIG. 3 in a perspective illustration of the detail.

As the exemplary illustration according to FIG. 4 reveals, the plate packet 4 illustrated here consists of a plate stack 16 which has four plate pairs 15 which are arranged between two individual plates 14 serving as cover plates. The individual plates 14 are in each case of identical design here and are connected in a mirror-inverted manner with respect to one another to form a plate pair 15. This connection preferably takes place in an integrally bonded manner by means of welding, specifically along the longitudinal edges 17. First channels K1 which are of tubular design are formed here between the individual plates 14, which in each case form a plate pair 15, specifically for the medium M1 participating in the heat exchange during correct use. By the plate pairs 15 being joined together to form a plate stack 16 along the transverse edges 18, wavy channels K2 for the other medium M2 which participates in the heat exchange and is conducted in cross flow with respect to the medium M1 are produced between the individual plates 14, lying on one another, of adjacent plate pairs 15. The second medium M2 is the pressurized high-pressure medium. However, the plate pair 4 can also have a different structure.

As furthermore emerges from FIG. 3, each individual plate 14 is provided with a plurality of parallel rows of embossed sections 21 running in the direction of the longitudinal edges 17. Said embossed sections 21 of adjacent rows are formed offset with respect to one another in the longitudinal direction, thus resulting, between individual plates 14 bearing on one another, in flat supports between embossed sections 21 following one another in a row.

Connecting wedges 20 are arranged in the corner regions 19 of a plate packet 4 between the individual plates 14 of adjacent plate pairs 15. Said connecting wedges 20 firstly separate the wavy side from the tubular side in the entry and exit region of the media M1 and M2 and secondly serve overall for the stabilized configuration of the plate packet 4.

Figure 2:
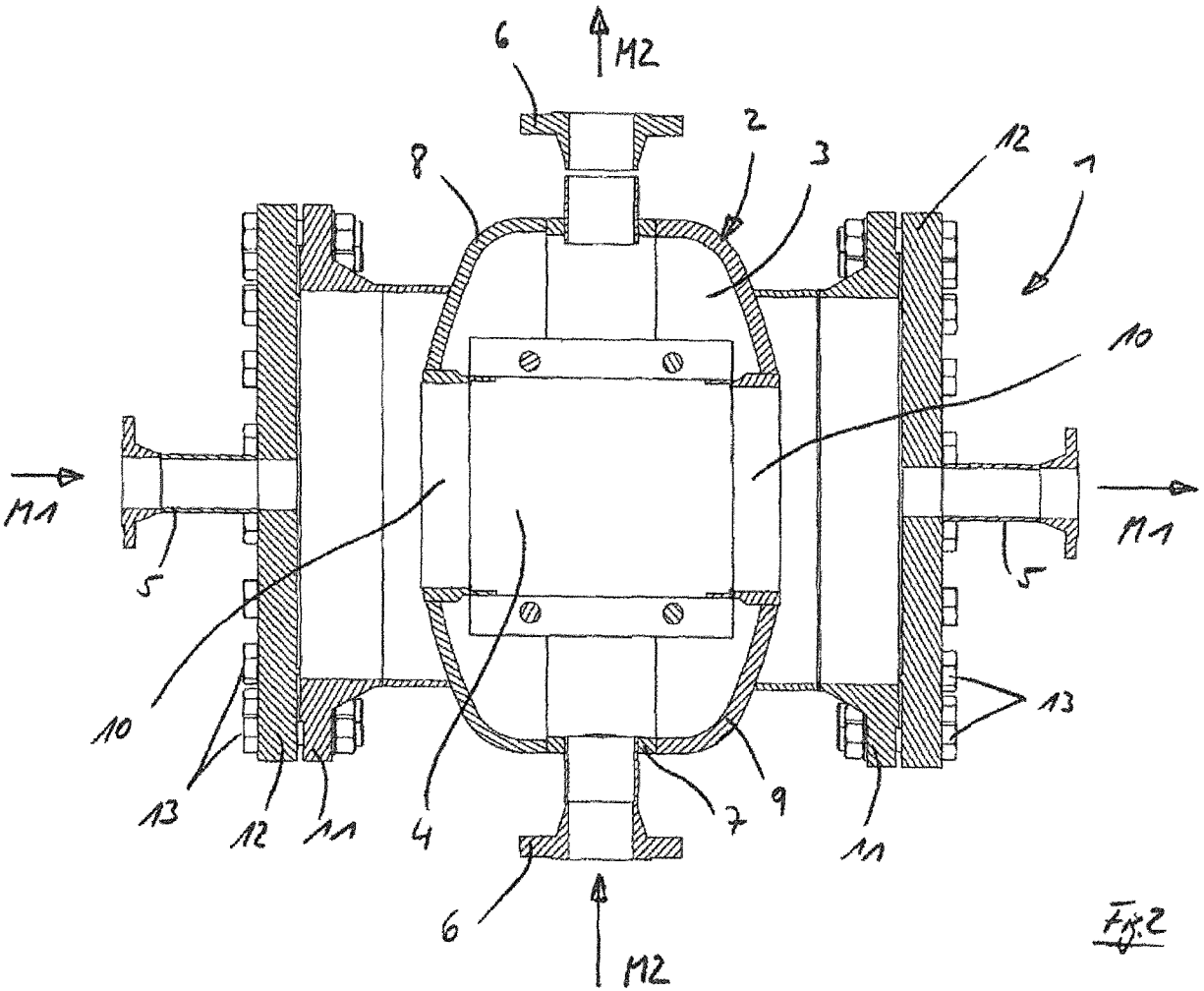
FIG. 2 shows, in a sectional illustration, the high-pressure plate heat exchanger according to FIG. 1 as per intersecting line II-II.

As can be gathered from FIG. 2, the housing 2 is formed from an annular section 7 and two flange covers 8 and 9. The flange covers 8 and 9 each provide an opening 10 for the tubular side, which openings are formed in accordance with the geometrical configuration of the plate packet 4 and serve for receiving the plate packet 4. The flange covers are of at least partially spherical design, preferably in the manner of a torospherical head, and therefore the housing 2 adjoins the plate stack 4 on the wavy side in a spherical configuration.

Figure 7:
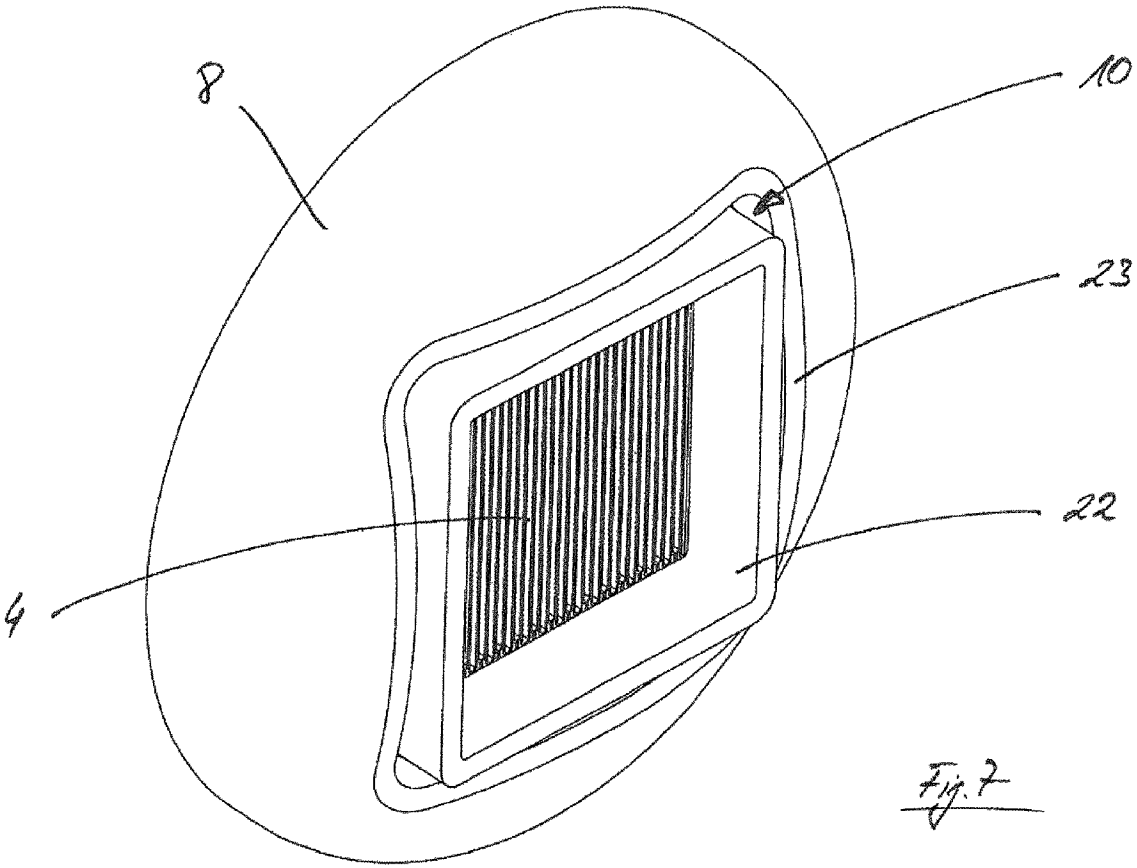
FIG. 7 shows an embodiment of a flange cover according to the invention.

FIG. 7 shows an embodiment of a flange cover 8 according to the invention in detail. The plate packet 4 here is of square design. Accordingly, the opening 10 in the flange cover 8 is likewise of square design, with regard to the clear dimensions. The opening 10 is bounded by the edge 23 of the flange cover 8. The edge 23 has a three-dimensional profile, wherein the side edges curve from the corners of the opening 10 to the tip of the flange cover 8. The corners themselves are of slightly rounded design.

A frame 22 is inserted into the opening 10. Said frame is designed in accordance with the geometrical configuration of the flange cover 8 or of the plate packet 4. The frame 22 accommodates the plate packet 4 or a connecting contour of the plate packet 4. As a result, the plate packet 4 is held together in an improved manner. The plate packet 4 and the frame 22 can be connected to each other, in particular welded. The plate packet 4 can then be handled together with the frame 22 as a unit. The plate packet 4 can thereby be inserted in a particularly simple manner into the opening 10 in the flange cover 8.

The connection between the frame 22 and the plate packet 4 can take place in a simple manner using the above-described connecting wedges 20. By means of the connecting wedges 20, the individual plates 14 or the plate pairs 15 are connected to one another in a pressure-proof and solid manner. The frame 22 can be attached, in particular welded, to the connecting wedges 20. The frame 22 can be of integral design, for example as a milled part, or of multi-part design, wherein, in the event of a multi-part configuration, the individual parts preferably are welded to one another.

The respective flange covers 8 and 9 are provided with a flange 11 which, for its part, bears a respective flange plate 12 which is connected thereto by means of screws 13. The flange plates 12 are provided with connecting pieces 5 for the first medium, that is to say the low-pressure medium. Instead of the previously explained flange construction (11, 12, 13), the side with tubular channels for medium M1 can also be welded by spherical bases directly to the flange covers 8 and 9. On the wavy side, the plate packet 4 is connected in terms of flow to the second medium, that is to say to the high-pressure medium, via connecting pieces 6.

During correct use, the pressurized second medium M2 is introduced on the wavy side into the plate packet 4 in accordance with the arrows shown in FIG. 2 and, after flowing through the plate packet 4, leaves the high-pressure plate heat exchanger 1 again via the connecting piece 6 provided for this purpose. Over the course of the correct use, the introduced fluid flows into the pressure chamber 3 provided by the housing 2, and therefore an external pressure which is identical to the internal pressure acts on the plate packet 4, and therefore the plate packet 4 or the individual plates 14 of the plate packet 4 are positioned as a whole without pressure or, in the case of loading on one side with the first medium M1 of the low-pressure side, are loaded only with the lower pressure of the first medium M1.

The medium with the lower pressure, that is to say the first medium, flows in cross flow with respect to the second medium, specifically, in accordance with the arrows according to FIG. 2, over the tubular side of the plate packet 4. Both tubular side and wavy side can be operated in a multi-way manner. Deflections are provided here on the tubular side between plate packet 4 and housing and deflections are provided here on the wavy side in the plate packet 4 and between plate packet 4 and housing. By means of the multi-way connection, operation in cross counterflow is possible.

Figure 6:
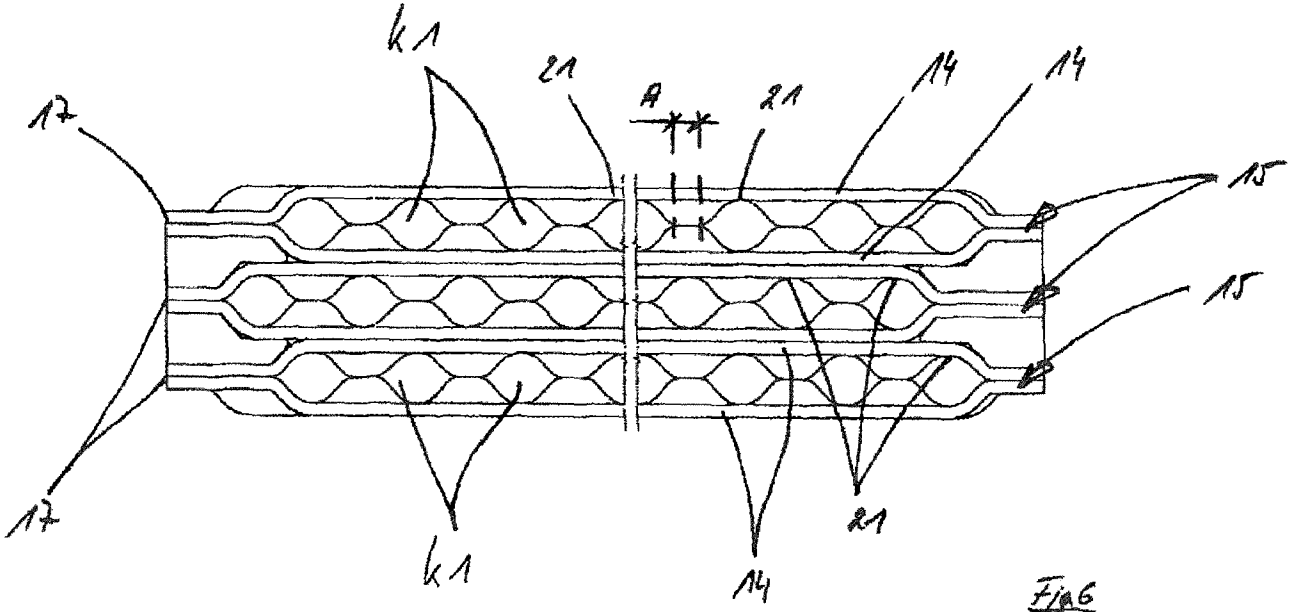
FIG. 6 shows the plate packet according to FIG. 3 in a side view.

As can furthermore be gathered from the illustration according to FIG. 6, the channels K1 on the tubular side are defined in the geometrical dimensions thereof inter alia by the distance of the embossed sections 21 which are formed offset with respect to one another in adjacent rows. This distance A is shown by way of example in FIG. 6.

Figure 8:
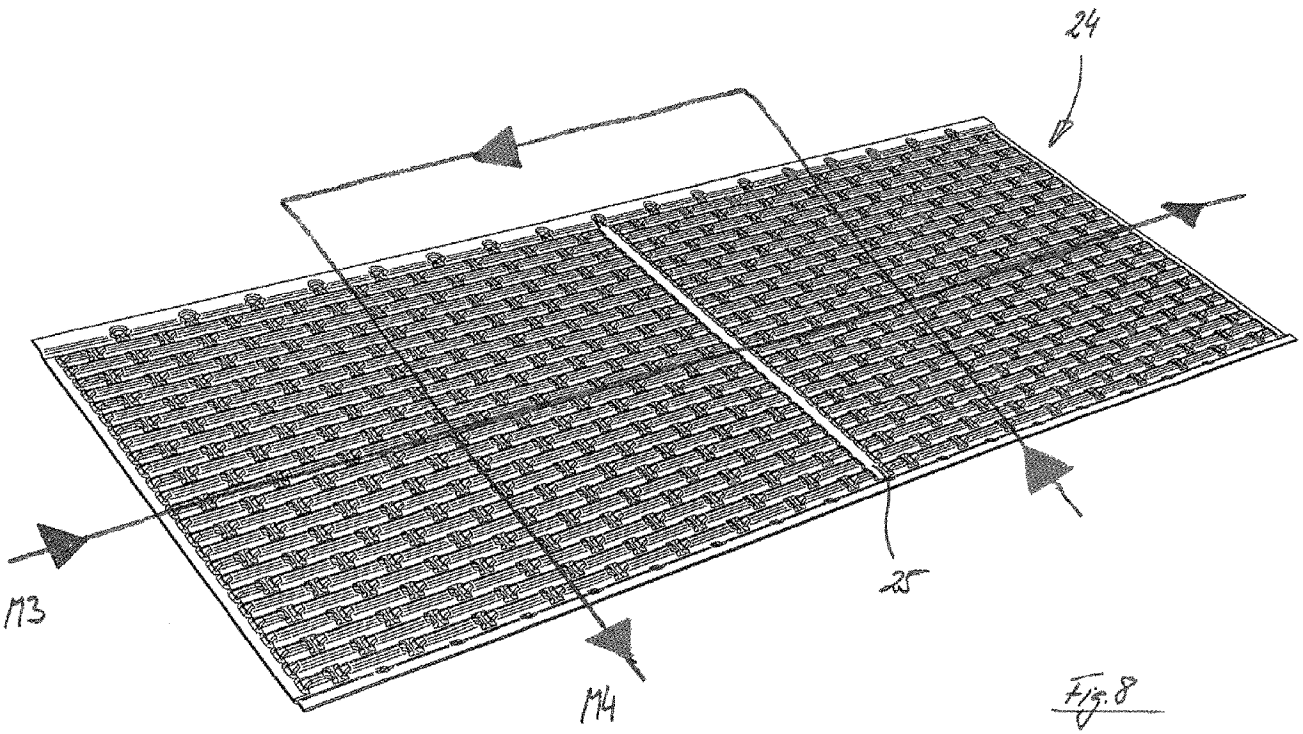
FIG. 8 shows an embodiment of an individual plate according to the invention with an empty point.

FIG. 8 shows an embodiment of an individual plate 24 according to the invention with an empty point 25. The empty point 25 extends transversely with respect to the longitudinal direction of the individual plate 24. The empty point 25 extends substantially over the entire width of the individual plate 24. If two individual plates 24 are arranged one on the other, the empty points 25 thereof are in contact with one another. The two individual plates 24 can then be connected to one another, in particular welded, in the region of the empty points 25. This immediately affords two advantages. Firstly, the stability of the plate pair formed in this manner and therefore also the stability of a plate packet 4 formed with individual plates of this type are significantly increased. This is of advantage in particular in the case of high-pressure applications and here in particular in the case of comparatively long, continuous individual plates 24. The plates of a plate heat exchanger can namely be pushed apart under some circumstances as a consequence of the fluid pressure, which adversely affects the function of the heat exchanger since the correct flow paths are no longer adhered to. The empty point 25 affords a further advantage. One and the same individual plate 24 can thus be divided in the longitudinal direction thereof into regions separated from one another in terms of flow. This permits one and the same individual plate 24 to be able to be acted upon with fluid in an alternating cross counterflow. The corresponding flow paths of a first medium M3 and of a second medium M4 are illustrated in FIG. 8.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A high-pressure plate heat exchanger having a plate packet which is of polygonal design and is arranged in a pressure chamber provided by a housing, wherein the housing has flange covers of at least partially spherical design, wherein at least one of the flange covers has an opening of polygonal design for receiving the plate packet, wherein the polygonal design of the opening differs from a mathematically polygonal shape in that an edge of the flange cover, which edge forms the opening, runs in a curved manner from the corners of the opening.

2. The heat exchanger as claimed in claim 1, wherein the plate packet is inserted into the opening with an intermediate arrangement of a frame.

3. The heat exchanger as claimed in claim 1, wherein the depth of a frame is designed in such a manner that the frame is in contact with one of the flange covers over the entire edge of the opening.

4. The heat exchanger as claimed in claim 1, wherein at least one end of the plate packet opens directly into the opening of one of the flange covers.

5. The heat exchanger as claimed in claim 1, wherein the flange covers are each designed as a torospherical head.

6. The heat exchanger as claimed in claim 1, wherein the plate packet is formed from a multiplicity of individual plates which are connected to one another to form a plate stack.

7. The heat exchanger as claimed in claim 6, further including connecting wedges arranged in corner regions of the plate stack between two adjacent plate pairs.

8. The heat exchanger as claimed in claim 6, wherein the individual plates have a plate thickness of 1.2 mm to 2.0 mm.

9. The heat exchanger as claimed in claim 6, wherein the individual plates are provided with a plurality of parallel rows of embossed sections running in the longitudinal direction, wherein the embossed sections of adjacent rows are offset with respect to one another in the longitudinal direction.

10. The heat exchanger as claimed in claim 6, wherein the plate packet is designed on a wavy side to be open toward the pressure chamber provided by the housing.

* * * * *